US009719760B2

(12) United States Patent
Strömberg et al.

(10) Patent No.: US 9,719,760 B2
(45) Date of Patent: Aug. 1, 2017

(54) FIN DEPLOYMENT MECHANISM AND PROJECTILE WITH SUCH A MECHANISM

(75) Inventors: Sven Strömberg, Karlskoga (SE); Johan Lidgren, Karlskoga (SE); Peter Engman, Karlskoga (SE); Lars-Peter Svanberg, Solna (SE); Lars-Ake Carlqvist, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 260 days.

(21) Appl. No.: 14/111,397

(22) PCT Filed: Apr. 12, 2012

(86) PCT No.: PCT/SE2012/000053

§ 371 (c)(1),
(2), (4) Date: Dec. 12, 2013

(87) PCT Pub. No.: WO2012/141641

PCT Pub. Date: Oct. 18, 2012

(65) Prior Publication Data

US 2014/0131509 A1 May 15, 2014

(30) Foreign Application Priority Data

Apr. 14, 2011 (SE) ..... 1130029

(51) Int. Cl.
*F42B 10/20* (2006.01)
*F42B 10/16* (2006.01)

(52) U.S. Cl.
CPC ..... *F42B 10/20* (2013.01); *F42B 10/16* (2013.01)

(58) Field of Classification Search
CPC ..... F42B 10/20; F42B 10/14; F42B 10/22
See application file for complete search history.

(56) References Cited

U.S. PATENT DOCUMENTS 3,031,967 A * 5/1962 Jasse ..... F42B 10/18 244/3.29
3,136,250 A 6/1964 Humphrey
3,242,861 A * 3/1966 Reed, Jr. ..... F42B 10/14 102/385

(Continued)

FOREIGN PATENT DOCUMENTS

DE 2635676 A1 2/1978
GB 976483 A 11/1964

(Continued)

*Primary Examiner* — Brian M O'Hara
(74) *Attorney, Agent, or Firm* — Polsinelli PC

(57) ABSTRACT

The invention relates to a fin deployment mechanism (1) comprising a base unit (3), deployable fins (8) movably arranged on the base unit (3) and, in the retracted position, bearing against the base unit (3), as well as a gas-generating device, in which the fins in the retracted position are fixed to the base unit, and in which at least one gas duct (6, 7) is arranged in the base unit (3) so as to conduct pressurized gas generated by the gas-generating device to the bottom side of the fins (8), which in the retracted position bear against the base unit (3), in order to create a force which acts on the fins (8) for deployment of the same (8'). The invention further relates to an artillery projectile comprising a fin deployment mechanism.

19 Claims, 3 Drawing Sheets

(56) References Cited

U.S. PATENT DOCUMENTS

| | | | | |
|---|---|---|---|---|
| 3,633,846 | A * | 1/1972 | Biggs, Jr. | F42B 10/20 102/384 |
| 4,158,447 | A | 6/1979 | Humphries et al. | |
| 4,607,810 | A | 8/1986 | Frazer | |
| 5,211,358 | A | 5/1993 | Bagley | |
| 7,083,141 | B2 | 8/2006 | Nitenson et al. | |
| 7,226,016 | B2 | 6/2007 | Johnsson et al. | |
| 2003/0146342 | A1 | 8/2003 | Hellman | |
| 2008/0111020 | A1 | 5/2008 | Peterson | |
| 2011/0072957 | A1* | 3/2011 | Travis | F41F 3/042 89/1.806 |

FOREIGN PATENT DOCUMENTS

| | | | |
|---|---|---|---|
| GB | 977111 | A | 12/1964 |
| GB | 2068463 | A | 8/1981 |
| JP | H6-94397 | | 4/1994 |

* cited by examiner

FIN DEPLOYMENT MECHANISM AND PROJECTILE WITH SUCH A MECHANISM

CROSS REFERENCE TO RELATED APPLICATIONS

This application is a National Phase filing under 35 U.S.C. §371 of PCT/SE2012/000053 filed on Apr. 12, 2012; and this application claims priority to Application No. 1130029-0 filed in Sweden on Apr. 14, 2011, under 35 U.S.C. §119; the entire contents of all are hereby incorporated by reference.

TECHNICAL FIELD

The present invention relates to a fin deployment mechanism for projectiles in which fin deployment takes place along the path of the projectile, and further relates to an artillery projectile constructed with a fin deployment mechanism in which fin deployment takes place along the path of the projectile.

BACKGROUND TO THE INVENTION, PROBLEM DEFINITION AND PRIOR ART

In order to achieve stability in the path between launcher and target, stabilization of a projectile can be realized by, preferably, rotation stabilization and/or fin stabilization. For a fin-stabilized barrel-launched projectile, fin deployment must take place after the projectile has left the barrel, since the fins cannot be deployed in the barrel. In order to achieve good manoeuvrability, modern projectiles for artillery purposes often have guide fins or so-called canard fins arranged for guidance of the projectile, which projectiles can at the same time have a finned and rotating tail section or base in order to acquire advantages associated with fin stabilization. Projectiles of this type consequently consist of a fin-stabilizing tail section and a roll-stable front part, the shell body, with guide fins. For such projectiles, the tail section and the shell body are freely movable with respect to each other and the shell body preferably assumes a rotationless state in order to extend deployable guide fins or canard fins which guide the shell. From a communications viewpoint, a non-rotating shell body is suitable for visual or radio communication, for example, since the sensor or antenna on the shell body essentially assumes a rotationless state. Irrespective of the type of projectile, the fin deployment method, as well as the fin deployment mechanism, is of great importance.

Previously known inventions include, for example, U.S. Pat. No. 7,226,016 B2, which describes a method and a device for pressurizing a pressure chamber in the shell body with gas pressure created by the propelling charge during the launch process. The pressure which is created in the pressure chamber is sufficient to displace an external element on the shell body, such as, for example, a protective cap for the fins.

An example of another previously known invention is U.S. Pat. No. 7,083,141 B2, which describes a projectile having radially deployable fins using an accompanying pressurized gas cartridge, which is also used to propel the projectile.

OBJECT OF THE INVENTION AND ITS DISTINGUISHING FEATURES

In an existing solution according to the above-stated document U.S. Pat. No. 7,226,016 B2, fin deployment is realized by virtue of the fact that a cap encloses the fins, which fins are mechanically deformed around the shell body. At a predetermined position, generally directly after the projectile has left the barrel, the cap is cast off from the shell and the fins, due to the spring force in the deformation, are extended into a fully deployed position. In the fully deployed position, the fins are locked with a locking mechanism. The whole of the projectile, and thus the finned base, as well as the shell body, rotate. When guide fins/canard fins are deployed, the shell body will be roll-stabilized, at the same time as the rotation of the tail section continues. With guide fins deployed, the guidance of the projectile towards the target can be commenced.

The present invention is constituted by a fin deployment mechanism comprising a base unit, deployable fins movably arranged on the base unit and, in the retracted position, bearing against the base unit, as well as a gas-generating device, in which the fins in the retracted position are fixed to the base unit, and in which at least one gas duct is arranged in the base unit so as to conduct pressurized gas generated by the gas-generating device to the bottom side of the fins bearing in the retracted position against the base unit, in order to create a force which acts on the fins for deployment of the same.

According to further aspects of the improved fin deployment mechanism according to the invention:

the fins are fixed to the base unit with chemical binding agent;

the chemical binding agent is a thermosetting plastic;

a ring formed of combustible material is arranged to hold the fins, in the retracted position, fixed to the base unit;

the ring is made of propellant;

the fins are fixed to the base unit with a shear stud mounted between the fins and the base unit;

the fins are fixed to the base unit with a soldered joint;

at least one groove is made in the fins in order in the retracted position to conduct gas created by the gas-generating device to the gas ducts;

the number of gas ducts is two per fin;

the number of fins is two or more in number;

the number of fins is six in number;

the depth of the gas ducts in the radial direction from the outer radius of the base unit in towards the centre is 2 to 50 times the width of the gas ducts;

the length of the gas ducts in the longitudinal direction of the base unit is 2 to 80 times the width of the gas ducts.

The invention further relates to an artillery projectile comprising a fin deployment mechanism comprising a base unit, deployable fins movably arranged on the base unit and bearing in the retracted position against the base unit, and also a gas-generating device, in which the fins in the retracted position are fixed to the base unit and in which at least one gas duct is arranged in the base unit so as to conduct pressurized gas generated by the gas-generating device to the bottom side of the fins bearing in the retracted position against the base unit, in order to create a force which acts on the fins for deployment of the same.

Advantages and Effects of the Invention

In an existing solution for fin deployment, a cap mounted on the tail section of the projectile is used as protection around the fins. When a projectile of this type leaves the barrel, the cap is pushed away from the fins, and thus the projectile, by a mechanism built into the projectile. Once the cap cast off from the projectile has been accelerated to the same speed as the projectile and is acted on by wind forces, then the cap per se will also become a projectile and give rise to an increased risk for persons and equipment in the environment of the launcher. By eliminating the cap, the risks of unwanted injuries or damage is reduced. A capless solution also means a simpler design with fewer integral components.

LIST OF FIGURES

The invention will be described in greater detail below with reference to the appended figures, in which.

DETAILED DESCRIPTION OF EMBODIMENTS

Figure 1:
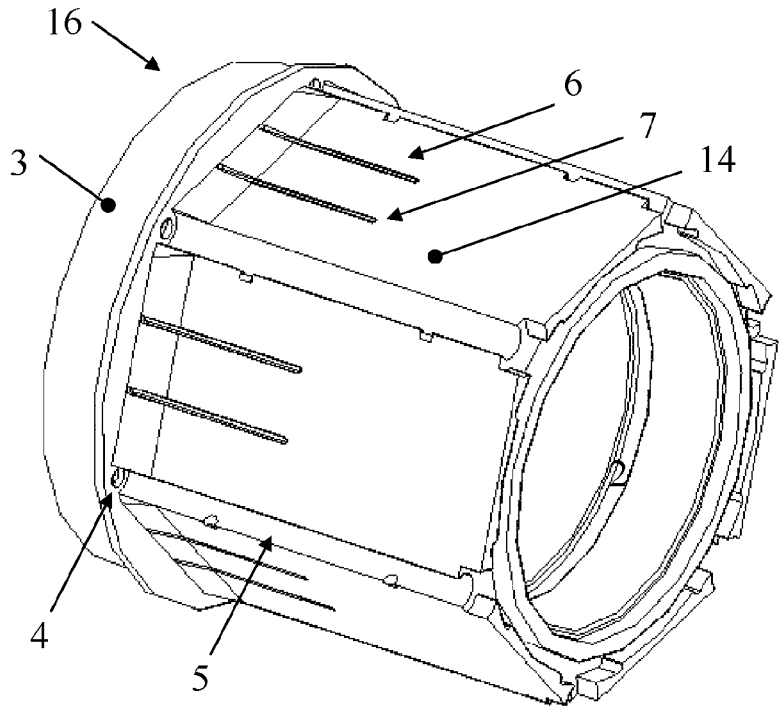
FIG. 1 shows the base without fins according to the invention.

In FIG. 1, the base unit 3, also referred to as the base 3, is shown without fins 8. The fins 8 are mounted on an axle which is positioned in an axle trench 5 and mounted in mounting holes 4. The base 3 is mounted with a coupling device 16 in the form of a fixed joint which rigidly connects the base 3 to the shell body 13 or to a rotary bearing, such as, for example, a ball bearing or other bearing with low friction, which allows rotation with respect to the shell body 13. In the base is found an empty space 2 for mounting of the base flow unit (not shown in the figure), which often consists of a powder charge. In the base 3 are found one or more gas ducts 6 and 7 for holding pressurized gas intended to open the fins 8 after the projectile has left the barrel. If two gas ducts are used, then the first gas duct, the fin top duct 7, gives a gas pressure in the upper portion of the fin 8 for the creation of an increased force through a leverage on the fin, and the second gas duct, the fin base duct 6, gives a gas pressure on the lower part of the surface of the fin 8 in order to allow, together with rotation forces and acceleration forces acting on the projectile, full fin deployment into the locked outer position. The locking mechanism is not shown in the figure, the locking mechanism locks the fin in the fully deployed position. The two gas ducts are preferably configured to have a small outlet area relative to their volume. The length of the gas duct is large compared with the width of the gas duct. The gas duct is preferably realized in the form of a groove or recess in the base, and filling of gas into the gas duct is effected by gas flowing in beneath the fin 8 in the retracted position to the gas duct and emptying or evacuation of the gas duct is effected through the outlet area of the gas duct when the fin 8, depending on the gas pressure in the gas duct, is deployed from the base 3 and thus empties the gas duct. Alternative methods for filling gas into the gas duct can also be purpose-built ducts or holes which conduct gas to the gas duct.

Figure 2:
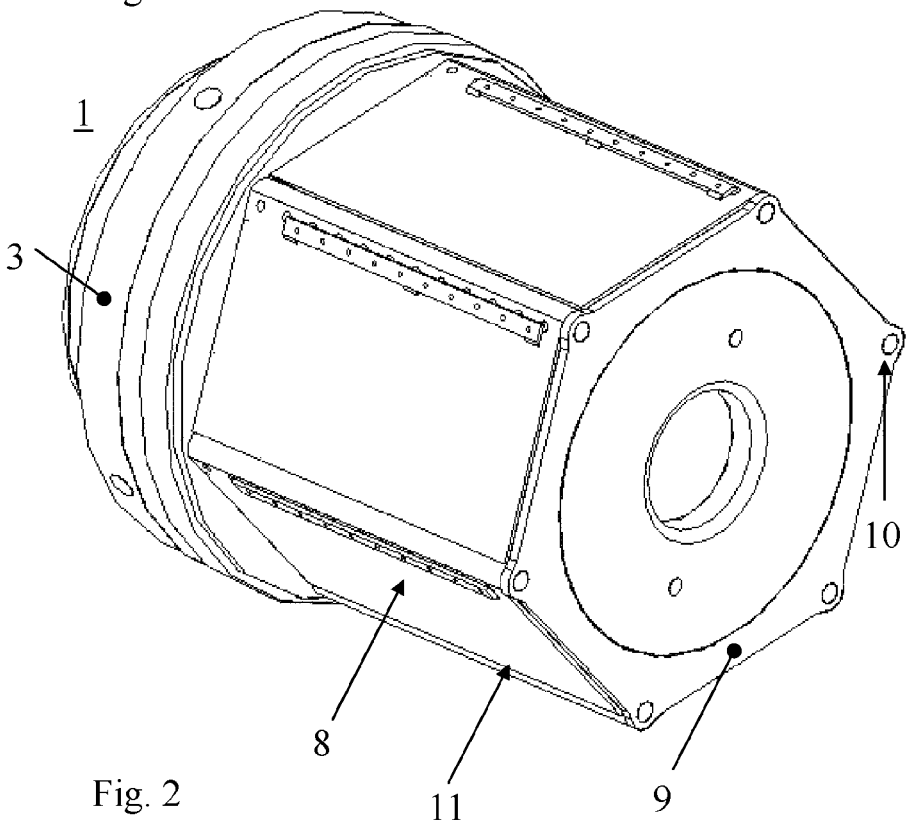
FIG. 2 shows the base with the fins retracted against the base according to the invention.

In FIG. 2, the fin deployment mechanism 1 comprising the base 3 is shown with the fins 8 in the retracted position. Each fin is fitted to or constructed in a unit with a fin axle 11, which is mounted in a mounting hole 4 on the base 3 and a mounting hole 10 on the base plate 9. The fins bear against the outer radius of the base, which is bevelled to obtain good surface contact between the surface of the fin and the surface of the base unit. The fins 8 are chemically or mechanically fixed to the base unit 3. The gas ducts 6 and 7 connect to the fin 8 in a seal-tight manner, for the gas of the gas duct, in order to ensure that the gas in the gas ducts 6 and 7 pressurizes the fin. However, the sealing tightness is not greater than to allow the gas ducts to be pressurized by gas which is generated from the propelling charge and which flows beneath the fins in the retracted position during the launch process.

Figure 3:
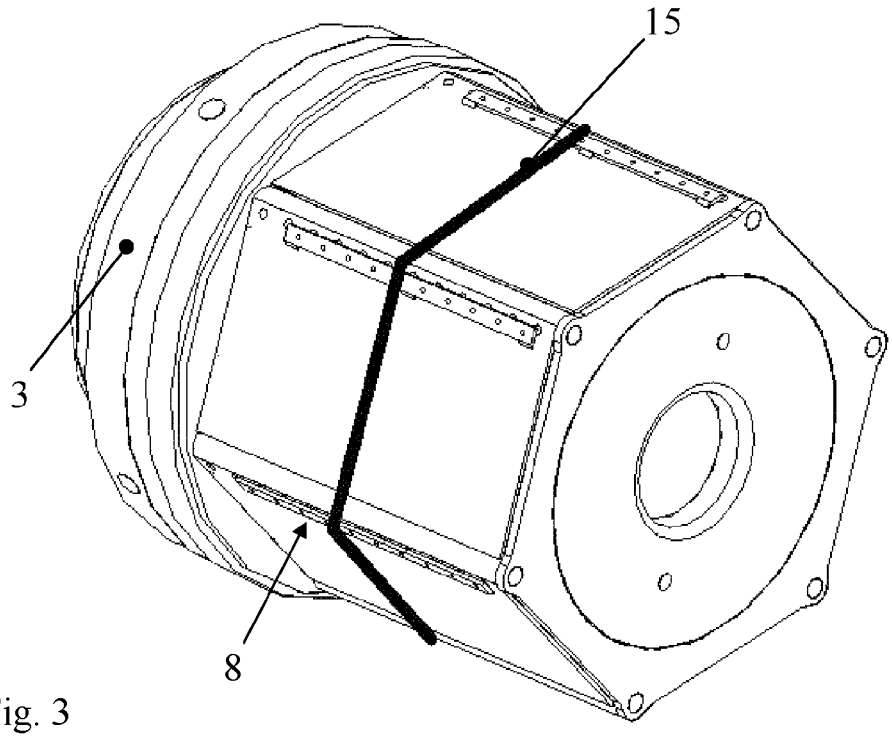
FIG. 3 shows the base with the fins retracted against the base, with an enclosing ring according to the invention.

In FIG. 3, the fin deployment mechanism 1 comprising the base 3 is shown with the fins 8 in the retracted position and enclosed by a ring 15 made of combustible material. The ring can be made of a suitable combustible material having a suitable ignition temperature or ignition point tailored to the particular embodiment of the projectile and the propelling charge.

Figure 4:
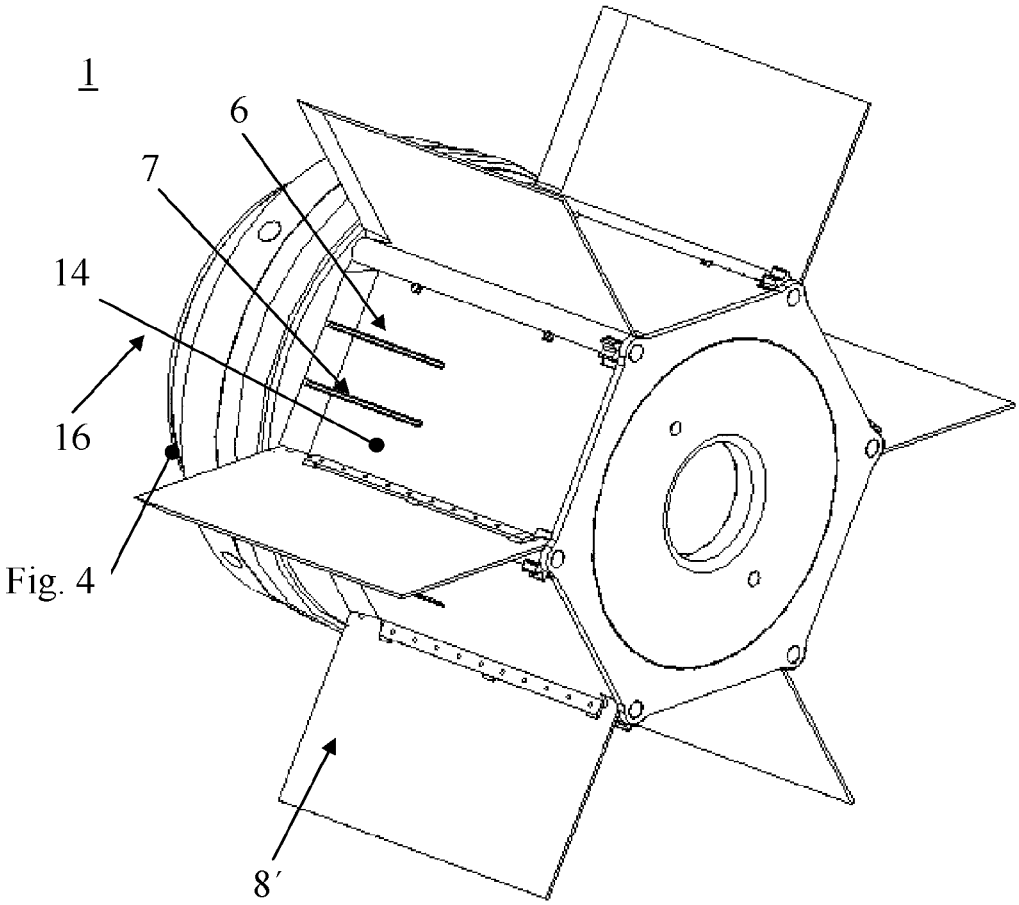
FIG. 4 shows the base with the fins in the retracted and locked position according to the invention.

In FIG. 4, the base is shown with the fins 8' in the deployed and locked position indicated with a glue point 14. In the top part of the fin 8, for example in the glue point 14, is applied a chemical binding agent, which binds the fin 8 to the base 3, so that the fin 8 is held against the base 3. The locking mechanism (not shown in detail in the figure) ensures that the fin is fixed in the deployed position.

Figure 5:
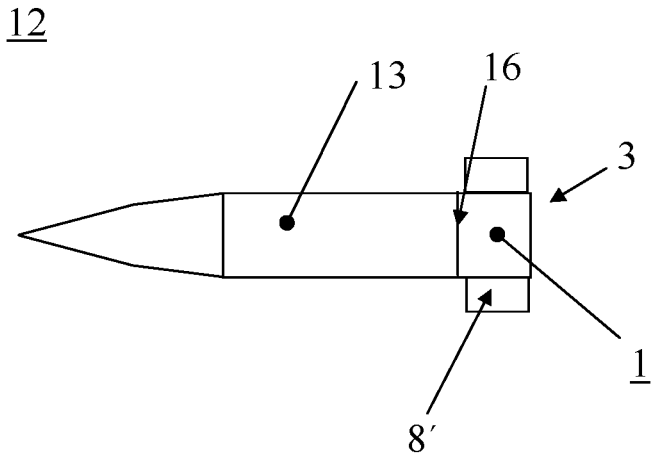
FIG. 5 shows an artillery projectile having a fin deployment mechanism according to the invention.

In FIG. 5, an artillery shell 12 is shown in the path between launcher and target with a fin deployment mechanism 1 comprising deployed fins 8' mounted on the fixed or rotatable base unit 3, which is fixedly mounted or freely rotatable with respect to and fitted to the shell body 13 by the coupling device 16.

Functional Description

The functioning and the use of the fin deployment mechanism 1 according to the invention is as follows. When the fins 8, 8', which can be flat, overlapping or retracted against the base 3, are to be deployed from the position retracted against the base 3, then that surface of the fin which bears against the base 3 is pressurized by a gas pressure built up in the gas ducts 6 and 7. When the pressure difference between the pressure generated in the gas duct 6 and 7 against the fins 8 and the ambient atmospheric pressure exceeds a certain limit value, which is determined by how the fin 8 is fitted or fixed to the base, the fins will start to be deployed from the base. The fins 8 are held against the base with, for example, a glue, adhesive, thermosetting plastic or other chemical binding agent applied at a glue point 14 preferably to the upper part of the fin 8 between the fin 8 and the base 3, but other embodiments and placement points, such as, for example, along the whole of the outer contour of the fin or the whole or parts of that surface of the fin 8 which bears against the base 3, are also possible. The fins 8 can also be held against the base 3 by a mechanical structure, such as a shear pin, shear stud, welded or soldered joint, which is broken at a certain pressure. Further devices for holding the fins 8 can be a ring 15 of combustible material fitted around the fins 8, which ring is wholly or almost wholly burnt in connection with the projectile leaving the mouth of barrel. Suitable materials for the ring 15 can be the same propellant which is used as the main propellant in the launch of the projectile, black powder or other ignitable and combustible material. The fins 8 open and are deployed almost instantaneously from the base 3, and thus the gas ducts 6 and 7 are emptied or ventilated almost instantaneously. When the fins are opened, aerodynamic forces come to act on the fin and open the fin into the fully deployed and locked position. Opening of the fins 8 cannot be started until the projectile has left the barrel, when a pressure difference arises between the pressure generated in the gas duct against the fins 8 and the ambient atmospheric pressure.

At launch, when the projectile is in the barrel and the gas ducts are pressurized and filled with gas, the pressure difference on each side of the retracted fin 8 is negligible or, in the ideal case, zero. The gas ducts 6, 7 are configured to contain a certain quantity of pressurized gas which has been generated by the propelling charge of the projectile during the launch process or by the base flow unit or other gas-generating device provided in the launch mechanism, the barrel, on the propelling charge or the projectile. The gas ducts 6, 7 advantageously have a small opening area with respect to the fins 8, at the same time as the volume of the gas ducts 6, 7 is large relative to the opening area.

At launch, the gas ducts 6, 7 are gas-filled with gas generated by a gas-generating device, mainly a propelling charge, by leakage in beneath the fins 8, at the same time as the projectile moves in the barrel. Specific grooves, slots or hole formations can possibly be made on the fins in order to facilitate the filling of the cavity beneath the fin. The cavity which is constituted by the gas ducts 6, 7 will be filled when an overpressure is built up during the launch process. Upon ignition of the propelling charge of the launcher, the pressure in the barrel starts to build and the generated gas fills the empty space behind the projectile, and thus also the cavity which is formed in the gas ducts 6, 7, the configuration or glue point 14 of the fin 8 not being affected when the gas fills the gas ducts 6, 7. When the projectile leaves the barrel, a rapid fall in pressure to atmospheric pressure instantaneously occurs around the projectile, which results in a pressure difference between the pressurized gas ducts 6, 7 and the outer side of the fins 8. The pressurized ducts will then create such force upon the fins 8 that they come loose from their fixing and opening and deployment of the fins 8 commences. When the fins 8 are deployed, the aerodynamic forces from both the speed and rotation of the projectile will act on the deployment and help to fully deploy and lock the fins 8' in the end position.

Illustrative Embodiments

Examples of a projectile with fin deployment mechanism are a 155 mm artillery shell with the fins cemented with glue, for example resin adhesive, and constructed with six fins, in which fin deployment starts directly after the projectile leaves the barrel and in which the number of gas ducts is 12 with two per fin and pressurized with propellant gases generated during the launch process.

Alternative Embodiments

The invention is not limited to the embodiments specifically shown, but can be varied in different ways within the scope of the patent claims.

It will be appreciated, for example, that the number, size, material and shape of the elements and parts included in the fin deployment mechanism are adapted to the weapon system(s) and other design features which pertain at that time.

It will be appreciated that the above-described projectile embodiments having a fin deployment mechanism can comprise many different dimensions and projectile types, depending on the field of application and the barrel width, such as artillery shells and bazookas, as well as missiles. In the above, however, reference is made to at least the currently most common shell types of between 25 mm and 200 mm.

The invention claimed is:

1. A fin deployment mechanism comprising a base unit, wherein the base unit has a flat surface, deployable fins movably arranged on the base unit, connected by an axle to the base unit and rotatable about the axle and, in a retracted position, bearing against the base unit, as well as a gas-generating device, wherein the fins in the retracted position are fixed to the flat surface of the base unit, and in that at least one gas duct is arranged in the base unit so as to conduct pressurized gas generated by the gas-generating device to a bottom side of the fins bearing in the retracted position against the base unit, in order to create a force which acts on the fins for deployment of the fins, wherein the fins are fixed to the base unit and bear against an outer radius of the base unit, and wherein the at least one gas duct is a groove or recess in the flat surface of the base unit and the length of the at least one gas duct in the longitudinal direction of the base unit is 2 to 80 times the width of the at least one gas duct.

2. The fin deployment mechanism according to claim 1, wherein the fins are fixed to the base unit with chemical binding agent.

3. The fin deployment mechanism according to claim 2, wherein the chemical binding agent is a thermosetting plastic.

4. The fin deployment mechanism according to claim 3, wherein at least one groove is made in the fins in order in the retracted position to conduct gas created by the gas-generating device to the gas ducts.

5. The fin deployment mechanism according to claim 2, wherein at least one groove is made in the fins in order in the retracted position to conduct gas created by the gas-generating device to the gas ducts.

6. The fin deployment mechanism according to claim 1, wherein a ring formed of combustible material is arranged to hold the fins, in the retracted position, fixed to the base unit.

7. The fin deployment mechanism according to claim 6, wherein the ring is made of propellant.

8. The fin deployment mechanism according to claim 7, wherein at least one groove is made in the fins in order in the retracted position to conduct gas created by the gas-generating device to the gas ducts.

9. The fin deployment mechanism according to claim 6, wherein at least one groove is made in the fins in order in the retracted position to conduct gas created by the gas-generating device to the gas ducts.

10. The fin deployment mechanism according to claim 1, wherein the fins are fixed to the base unit with a shear stud mounted between the fins and the base unit.

11. The fin deployment mechanism according to claim 10, wherein at least one groove is made in the fins in order in the retracted position to conduct gas created by the gas-generating device to the gas ducts.

12. The fin deployment mechanism according to claim 1, wherein the fins are fixed to the base unit with a soldered joint.

13. The fin deployment mechanism according to claim 12, wherein at least one groove is made in the fins in order in the retracted position to conduct gas created by the gas-generating device to the gas ducts.

14. The fin deployment mechanism according to claim 1, wherein at least one groove is made in the fins in order in the retracted position to conduct gas created by the gas-generating device to the gas ducts.

15. The fin deployment mechanism according to claim 1, wherein the number of gas ducts is two per fin.

16. The fin deployment mechanism according to claim 1, wherein the number of fins is two or more in number.

17. The fin deployment mechanism according to claim 1, wherein the number of fins is six in number.

18. The fin deployment mechanism according to claim 1, wherein the depth of the gas ducts in the radial direction from the outer radius of the base unit in towards the center is 2 to 50 times the width of the gas ducts.

19. An artillery projectile comprising a fin deployment mechanism, which comprises a base unit, wherein the base unit has a flat surface, deployable fins movably arranged on the base unit, connected by an axle to the base unit and rotatable about the axle and, in a retracted position, bearing against the base unit, as well as a gas-generating device, wherein the fins in the retracted position are fixed to the flat surface of the base unit, and in that at least one gas duct is arranged in the base unit so as to conduct pressurized gas generated by the gas-generating device to a bottom side of the fins bearing in the retracted position against the base unit, in order to create a force which acts on the fins for deployment of the fins, wherein the fins are fixed to the base unit and bear against an outer radius of the base unit, and wherein the at least one gas duct is a groove or recess in the flat surface of the base unit and the length of the at least one gas duct in the longitudinal direction of the base unit is 2 to 80 times the width of the at least one gas duct.

* * * * *